US005353947A

United States Patent [19]

Zinnbauer et al.

[11] Patent Number: 5,353,947

[45] Date of Patent: Oct. 11, 1994

[54] CASE HAVING A SLIDABLE AND PIVOTABLE COVER

[75] Inventors: Gerald B. Zinnbauer, Charlotte, N.C.; Jennifer S. Wittkop, Reisterstown, Md.

[73] Assignee: The Procter & Gamble Company, Cincinnati, Ohio

[21] Appl. No.: 10,105

[22] Filed: Jan. 28, 1993

[51] Int. Cl.[5] ..... B65D 43/14

[52] U.S. Cl. ..... 220/331; 220/326; 220/329; 220/338; 220/528; 220/553; 220/554; 206/581

[58] Field of Search ..... 220/326, 329, 331, 334, 220/338, 345, 346, 347, 351, 528, 553, 554; 206/581, 823, 45.15

[56] References Cited

U.S. PATENT DOCUMENTS

| | | | |
|---|---|---|---|
| 1,653,293 | 12/1927 | Kendall | 220/331 |
| 2,329,685 | 9/1943 | Baker | 206/44 |
| 2,338,477 | 1/1944 | Wolters et al. | 312/189 |
| 2,424,112 | 7/1947 | Nehrke | 220/38 |
| 2,867,348 | 1/1959 | Morrison | 220/331 |
| 3,342,190 | 9/1967 | Hultgren et al. | 220/338 X |
| 3,741,430 | 6/1973 | Bergh et al. | 220/331 |
| 4,420,079 | 12/1983 | Gliniorz et al. | 220/331 X |
| 4,502,609 | 3/1985 | Christatos | 220/329 |
| 4,580,586 | 4/1986 | Kitoh et al. | 132/83 |
| 4,615,461 | 10/1986 | Liu | 220/331 |
| 4,666,036 | 5/1987 | Bourbon | 206/45.23 |
| 4,693,364 | 9/1987 | Wakelin | 206/45.18 |
| 4,774,973 | 10/1988 | Gueret | 220/326 |
| 4,821,902 | 4/1989 | May | 220/1 T |
| 4,844,284 | 7/1989 | Drozd et al. | 220/281 |
| 4,898,195 | 2/1990 | Sussman | 220/345 X |
| 5,078,159 | 1/1992 | Yuhara | 206/581 X |
| 5,107,871 | 4/1992 | Butcher et al. | 206/823 X |

*Primary Examiner*—Allan N. Shoap
*Assistant Examiner*—Vanessa Caretto
*Attorney, Agent, or Firm*—John M. Howell; Kevin C. Johnson; E. Kelly Linman

[57] ABSTRACT

A case having a base and a cover is disclosed. The base and cover are releasably secured to one another in a first position such that the base and cover may be moved axially and may be pivoted with respect to one another. The base and cover are permanently secured to one another in a second position such that the base and cover may be pivoted with respect to one another. The respective movements of the base and cover in the first and second position enables the case to be displayed in a fully open condition allowing the consumer to view the product within the case.

11 Claims, 8 Drawing Sheets

CASE HAVING A SLIDABLE AND PIVOTABLE COVER

FIELD OF THE INVENTION

The present invention relates to cosmetic cases, and more particularly, to such cosmetic cases having a cover which is slidable and pivotable about the base.

BACKGROUND OF THE INVENTION

Cosmetic cases are, of course, well known in the prior art. Typically these cases have a base and a cover connected to one another by a hinge located in the rear portion of the case. The hinge may be of any design that makes it possible for the cover to pivot or rotate with respect to the base when the cosmetic case is opened and closed. A closure or latching device is provided in the front portion of the cosmetic case for securing the base and cover together. The cases are typically made of a material which is opaque such that when the cosmetic case is in its closed position, the product inside, e.g., face powder, foundation powder, eye shadow, or blush, is not visible to the user. Therefore, if the cosmetic case is packaged and displayed in the closed position, the consumer is unable to view the product inside the cosmetic case, thus making a decision on which shade of product to purchase difficult for the consumer. One way to solve this problem is to print a color swatch on the exterior of the package that represents the color of the product. Unfortunately, color swatches often do not accurately represent the color of the product inside the opaque cosmetic case.

In order to better accommodate the consumer, many manufacturers package and display the cosmetic case in a fully opened position, thus allowing the consumer to view the shade of the product at the point of purchase. However, packaging a cosmetic case in a fully opened position sacrifices valuable retail space as the case requires nearly double the space as it would in a closed position.

SUMMARY OF THE INVENTION

In accordance with one aspect of the present invention a case for cosmetics is provided. The case has front and rear portions and includes a base which has a front wall, a rear wall, a pair of side walls, and a common bottom wall which together define an interior compartment. Each of the walls has an interior surface and an exterior surface. The case also includes a cover having a front wall, a pair of side walls and a common top wall. Each of the walls has an interior surface and an exterior surface. The case includes a means for securing the base to the cover in a first position and a second position. The base and cover are releasably secured to one another in the first position such that the base and the cover may be moved axially and may be pivoted with respect to one another about the means. The base and cover are permanently secured to one another in the second position such that the base and the cover may be pivoted with respect to one another about the means. The case also includes a means for latching the base and the cover together. The means is located in the front portion of the case.

Preferably the means for securing the base to the cover includes a groove on the interior surface of each of the side walls of the cover. The means for securing the base to the cover preferably includes a pivot pin located on the exterior surface of each of the side walls of the base. The pivot pins on the base are preferably inserted into the grooves of the cover.

In a preferred embodiment the side walls of the cover include an assembly notch allowing the pivot pins of the base to be inserted into the grooves. The grooves in the cover preferably include a rib member located in the front portion of the cover for releasably securing the base and the cover to one another in the first position.

In a preferred embodiment the case of the present invention comprises a pivot pin receptacle in the grooves for permanently securing the base to the cover in the second position.

In a preferred embodiment the case of the present invention includes a platform secured to the base. The platform separates said base the into multiple sections or compartments. In a particularly preferred embodiment, the base is a single unit divided into several sections or compartments. Preferably, the base includes a flexible bar secured to the exterior surface of the front wall. The flexible bar includes an indentation which cooperates with the catch tab on the cover for latching the case together.

Preferably, the means for latching the base and the cover together includes a push button located on the front portion of the platform. In addition, the means for latching the base and the cover together includes a catch tab located on the cover. In a preferred embodiment, the push button includes an opening for receiving the catch tab.

BRIEF DESCRIPTION OF THE DRAWINGS

While the specification concludes with claims which particularly point out and distinctly claim the invention, it is believed that the present invention will be better understood from the following description of a preferred embodiment(s) taken in conjunction with the accompanying drawings, in which like reference numerals identify identical elements and wherein:

DETAILED DESCRIPTION OF THE INVENTION

Figure 1:
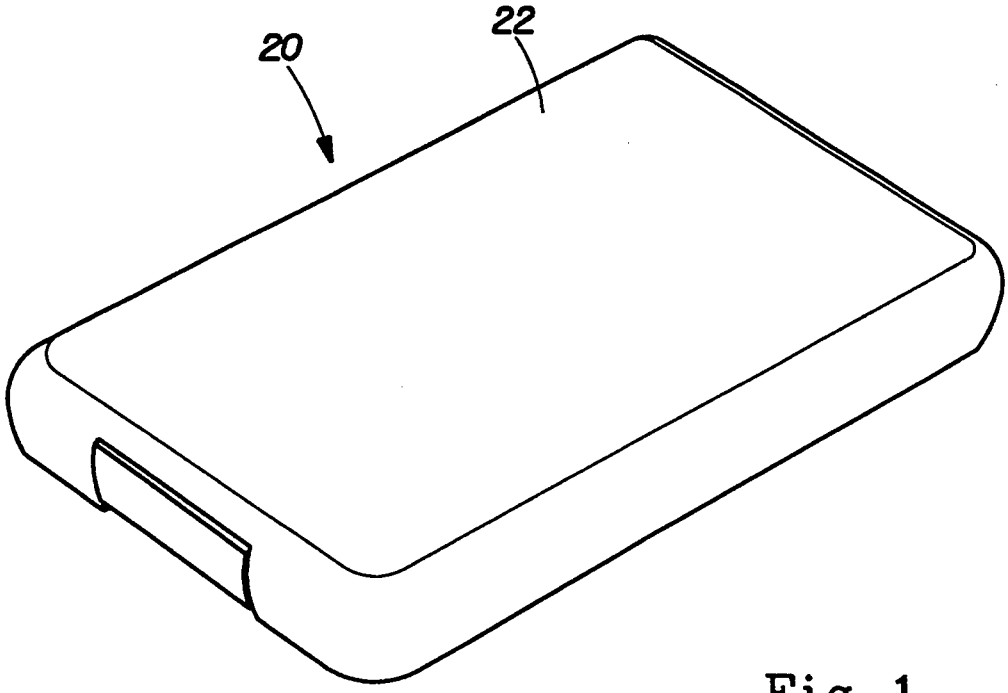
FIG. 1 is a perspective view of a preferred embodiment of the case of the present invention, in a closed position.
Figure 2:
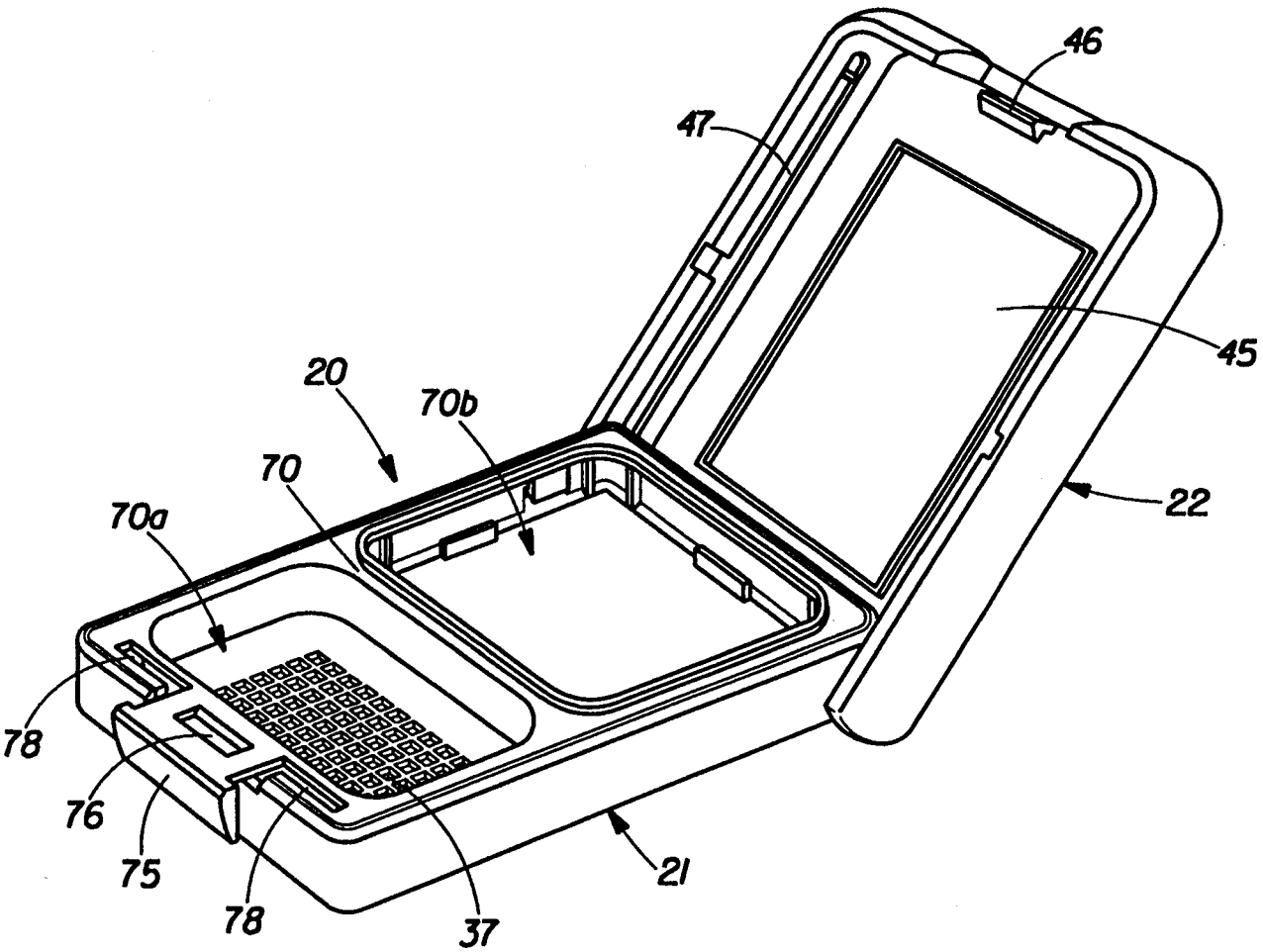
FIG. 2 is a perspective view of the case of FIG. 1, in an open position.

In a particularly preferred embodiment shown in FIGS. 1 and 2, the present invention provides a case for cosmetics, indicated generally as 20. The cosmetic case 20 comprises two main parts, a base 21 and a cover 22. As will be appreciated by those skilled in the art, the case 20 can be made of a wide variety of materials as well as assume a wide variety of sizes and shapes. For purposes of illustration only, the case 20 will be illustrated as having a generally rectangular shape. A platform 70, which is inserted into base 21, divides the interior compartment of base 21 into a front section 70*a* and a rear section 70*b*. The platform may be divided into any number of sections or compartments, e.g., two, three, four, etc., as desired.

Figure 3:
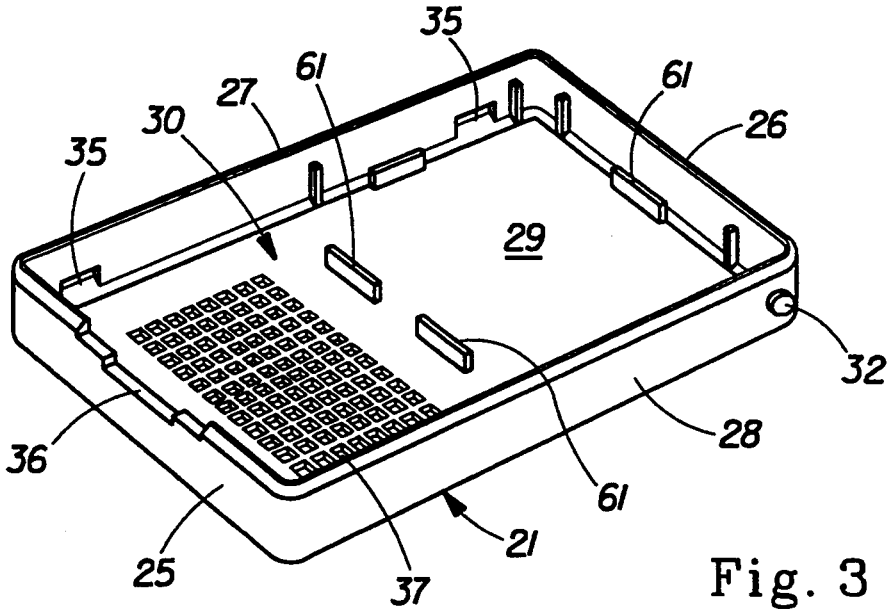
FIG. 3 is a perspective view of the base of the present invention.

Referring now to FIG. 3, the base 21 includes a front wall 25, a rear wall 26, side walls 27 and 28, and a common bottom wall 29. Front wall 25, rear wall 26, side walls 27 and 28, and bottom wall 29 together define interior compartment 30. Front wall 25, rear wall 26, side walls 27 and 28, and bottom wall 29 each have an interior surface and an exterior surface. The interior surface of each wall is that surface which is oriented towards the interior compartment 30. The exterior surface of each wall is that surface oriented away from the interior compartment 30 and opposed to the interior surface.

Base 21 has a front portion and a rear portion. The front portion of base 21 includes front wall 25 and portions of side walls 27 and 28 and bottom wall 29 adjacent front wall 25. The rear portion of base 21 includes rear wall 26 and portions of side walls 27 and 28 and bottom wall 29 adjacent rear wall 26.

Protruding from the rear portion of base 21 on the exterior surface of the side walls 27 and 28 are pivot pins 32. Pivot pins 32 will engage with grooves 47 in cover 22, as will be described in detail below, to secure base 21 to cover 22. The front wall 25 has an opening or indentation 36 positioned in the central portion.

The interior surface of side walls 27 and 28 includes a plurality catch slots 35. A plurality of locater blades 61 are positioned about the interior surface of bottom wall 29, along the periphery of side walls 27 and 28, and along the rear wall 26. The front portion of bottom wall 29 includes a plurality of apertures 37. Apertures 37 may be of any size or dimension as desired.

Figure 4:
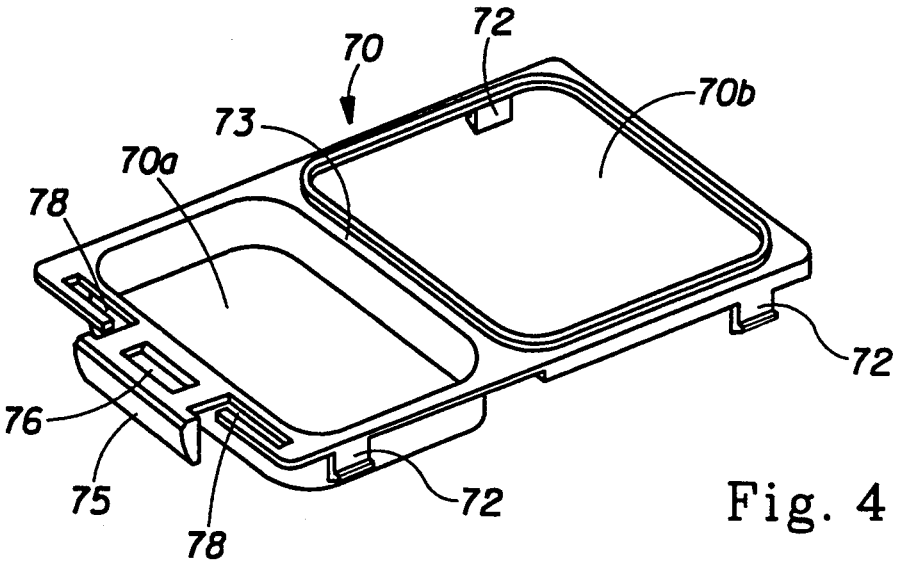
FIG. 4 is a perspective view of the platform of the present invention.

Referring now to FIG. 4, platform 70 includes a plurality of tabs 72. When the case is assembled, tabs 72 engage with catch slots 35 on the interior surface of side walls 27 and 28 to secure platform 70 to base 21. The platform 70 includes a divider wall 73 which divides the interior compartment 30 of base 21 into a front section 70*a* and a rear section 70*b*. The platform 70 may include any number of divider walls to divide the interior compartment 30 of base 21 into as many sections as desired. The front portion of platform 70 includes a flexible push button 75. Push button 75 includes an aperture 76 which forms a portion of the latching mechanism as will be described in greater detail below. The platform 70 also includes a pair of slots 78 located immediately adjacent catch button 75. Slots 78 permit the push button 75 to be pressed inwardly for operation of the latching mechanism, as will be described in greater detail below.

Figure 5:
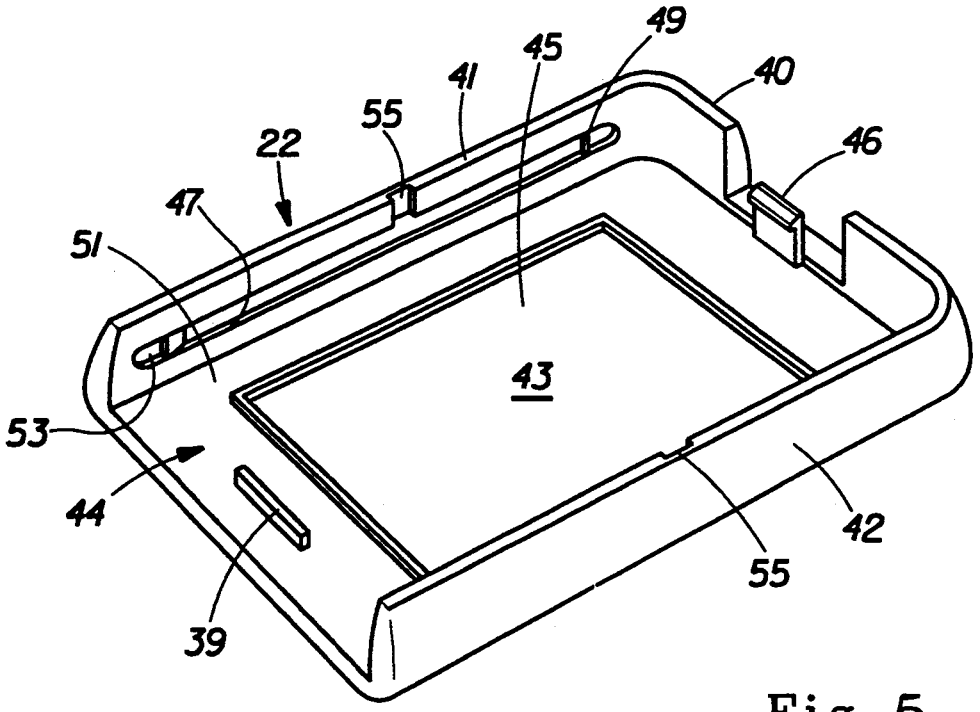
FIG. 5 is a perspective view of the cover of the present invention, with the interior surface of the cover exposed.

Referring now to FIGS. 2 and 5, the cover 22 is comprised of a front wall 40, side walls 41 and 42, a common top wall 43 and an opening 44. It is important that the dimensions of cover 22 be slightly larger than those of base 21 as will be evident from the description below. Front wall 40, side walls 41 and 42, and common top wall 43 each have an interior surface and an exterior surface. The exterior surfaces are those surfaces of cover 22 which are visible when the case 20 is in a closed position, as seen in FIG. 1. The interior surface is that surface opposed to the exterior surface. The cover 22 has a front portion and a rear portion. The front portion of cover 22 includes front wall 40 and portions of side walls 41 and 42 and top wall 43 adjacent front wall 40. The rear portion of cover 22 includes opening 44 and portions of side walls 41 and 42 and top wall 43 adjacent opening 44.

The interior surface of top wall 43 of cover 22 includes a mirror well 45 which can house a number of different shapes and sizes of mirrors. The rear portion of the interior surface of top wall 43 includes a cover stop 39. A catch tab 46 which comprises a portion of the latching means is located in the front portion of cover 22. The catch tab 46 cooperates with the opening 76 located in push button 75 as will be described in detail herein below. Side walls 41 and 42 each include a groove 47. Grooves 47 extend substantially the entire length of the interior surfaces of sidewalls 41 and 42. Each groove 47 includes a rib member 49 which is oriented substantially perpendicular to the length of the groove. Rib members 49 are located near the front portion of cover 22. At the rear portion of cover 22 in grooves 47 is ramped portions 51. Immediately adjacent the ramp portions 51 is pivot pin receptacles 53 about which base 21 is permanently affixed to cover 22, as will be described in detail herein below. The interior surface of side walls 41 and 42 includes assembly notches 55.

Figure 6:
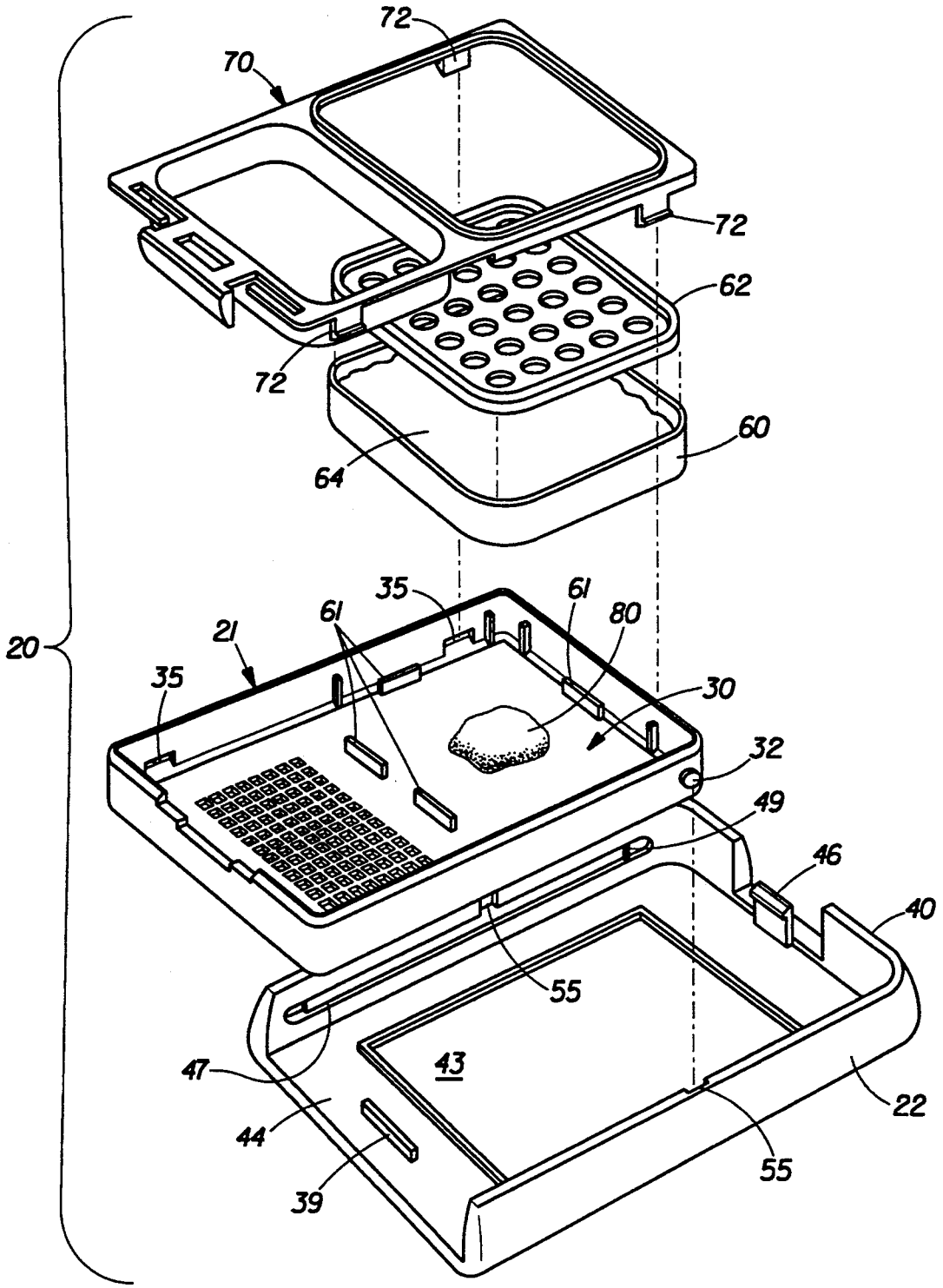
FIG. 6 is an exploded view of the case of the present invention including the cover, base, platform, cosmetic pan and screen.

The case 20 can be assembled at any point along the manufacturing process. The cover 22 and the base 21 can be assembled at the molding machine or held aside to be joined just before the case 20 is placed in a blister package for merchandising. An example of one assembly procedure is to first assemble the base 21 to the cover 22, and then proceed to fill the compact and attach the platform. This procedure will now be described in greater detail below. Referring now to FIG. 6, to assemble the cosmetic case 20, the cover 22 is turned upside down with the interior surface facing upward and with opening 44 of cover 22 exposed to receive the base 21. Preferably, a mirror is secured in mirror well 45 at this point. The base 21 is held in such a position that the exterior surface of bottom wall 29 is facing towards the interior surface of the top wall 43 of the cover 22. The pivot pins 32 of base 21 are aligned with the assembly notches 55. Pressure is then applied vertically to the base 21 forcing the pivot pins 32 down through the assembly notches 55 until the pivot pins 32 are positioned in the horizontal grooves 47 of the cover 22. This insertion step is assisted by a small bevel on the leading edge of the pivot pins 32 which rides against the beveled surface of the assembly notches 55. With the pivot pins 32 positioned within horizontal grooves 47, the base 21 is pushed in a direction toward the front wall 40 of cover 22, until the pivot pins 32 encounter rib members 49. The pivot pins 32 are pushed past rib members 49 where the pivot pins 32 are temporarily secured, and likewise base 21 and cover 22 are temporarily secured to one another.

While temporarily secured to cover 22, base 21 is ready to receive product in the interior compartment 30. An adhesive 80 is preferably deposited on the interior surface of bottom wall 29. A filled make-up pan 60 is then positioned onto adhesive 80. The make-up pan 60 is aligned within the rear portion of interior compartment 30 by locater blades 61. After make-up pan 60 has been secured to bottom wall 29, an optional molded screen 62 is pressed into the make-up 64 to a level equal with the pan's top edge. The molded screen 62 has an angular surface which forces the product 64 towards the center of the pan 60. After the screen has been secured to the pan 60, the platform 70 is then positioned over the base 21. Downward pressure is then applied to the platform 70 to insert it into the base 21 until the tabs 72 engage with their corresponding receptacles 35 located on the interior surfaces of the base 21, thereby securing the platform 70 to the base 21. A sponge or applicator (not shown) may preferably be placed within the front section 70*a*. The case 20 is now ready to be packaged for merchandising and consumer use.

Figure 7:
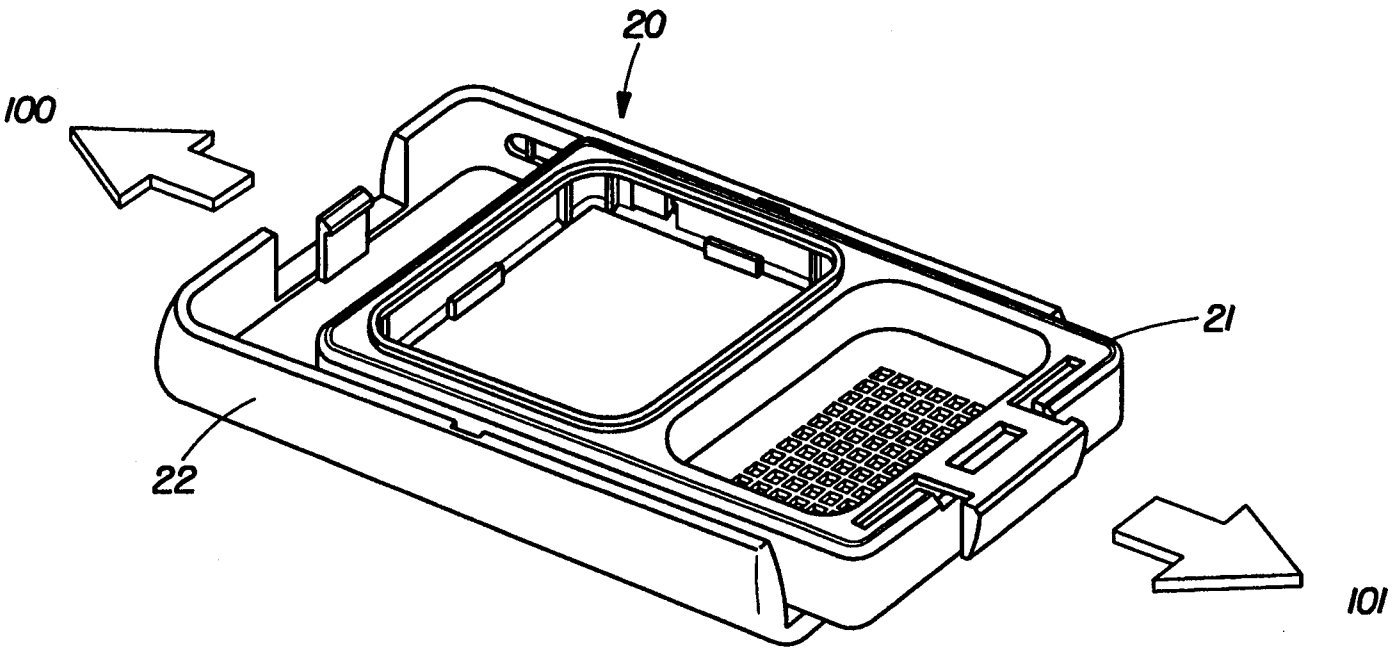
FIG. 7 is a perspective view of the assembled case of the present invention.
Figure 8:
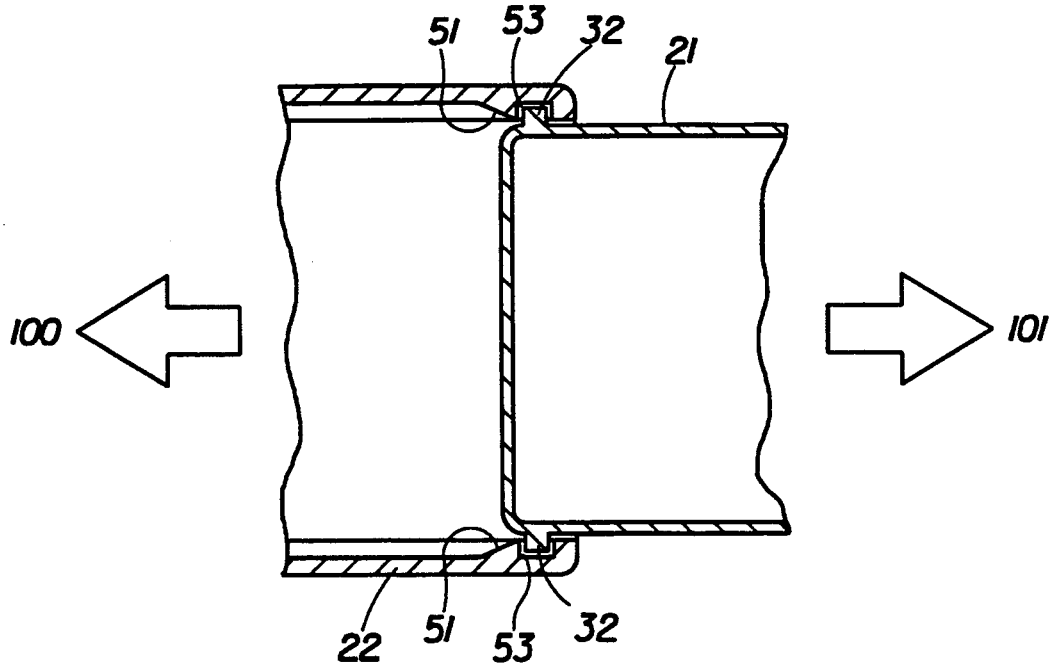
FIG. 8 is a segmented plan view of the case of the present invention.

To activate the case 20 from the packaged position illustrated in FIG. 7, the base 21 and cover 22 are pulled away from each other as indicated by arrows 100 and 101, such that pivot pins 32 are freed from the rib members 49 located in grooves 47. Referring now to FIG. 8, the base 21 is pulled away from cover 22 until the pivot pins 32 slide beyond inclined ramped portions 51 and snap into the pivot pin receptacles 53 where the pivot pins 32 are permanently secured, thereby permanently securing the base 21 to the cover 22. From this position, the case 20 is closed radially around the pivot relationship established between pivot pins 32 and receptacles 53. The cover 22 is rotated or pivoted to its closed position where the catch tab 46 passes through the platform catch opening 76 until it is secured therein.

From the packaged position illustrated in FIG. 7, the base 21 and cover 22 may be moved axially and may be pivoted with respect to one another about the pivot relationship established between pivot pins 32 and receptacles 53. Therefore, as the user pulls the base 21 and cover 22 away from each other as indicated by arrows 100 and 101, the front portion of base 20 and 21 may tend to float as it is not restrained to moving in a single plane. The rear portion of base 21 remains substantially in the same plane as its movement is restricted by the engagement of pivot pins 32 within grooves 47. Once pivot pins 32 are secured within pivot pins receptacle 53, the base 21 and cover 22 may only be pivoted with respect to one another about the pivot pin relationship established between pivot pins 32 and receptacles 53. This is because pivot pins 32 are restricted from moving within the grooves 47 by the configuration of the pivot pin receptacles 53.

To use the compact after closing, the consumer pushes the push button 75 inwardly toward the rear portion of the compact 20. The inward movement of push button 75 releases tab 46 from opening 76 allowing the case 20 to be opened. The cover stop 39 keeps the angle of the cover 22 at a constant in relation to the base 21 to provide a preferred viewing angle for the mirror. Since the base pivot pins 32 are permanently secured into the pivot pin receptacles 53 the base 21 and cover 22 are only permitted to pivot with respect to one another.

Figure 9:
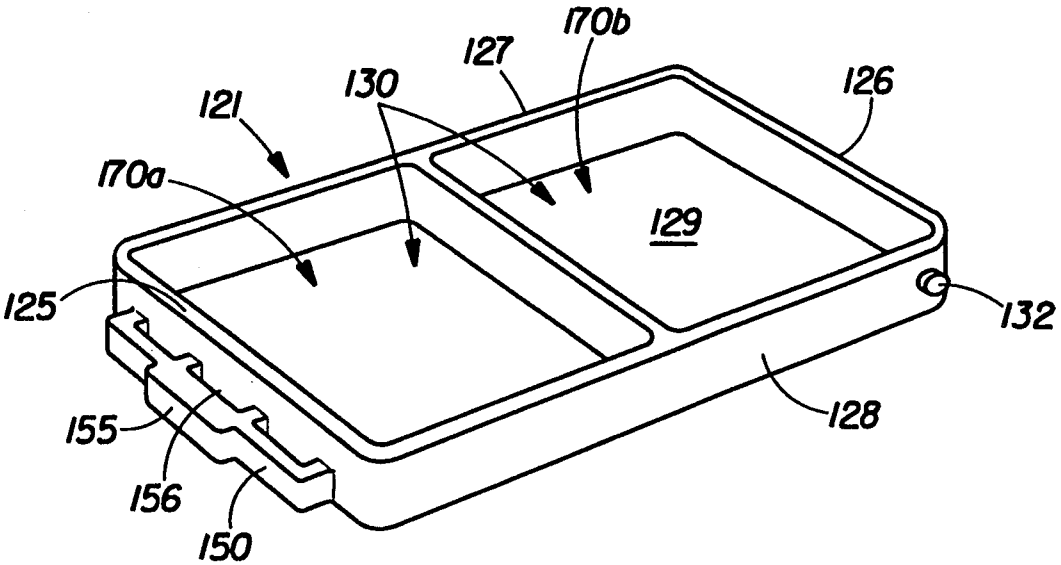
FIG. 9 is a perspective view of a particularly preferred embodiment of a base of the present invention.

Referring now to FIG. 9, there is shown a particularly preferred embodiment of a base 121 of the present invention. The base 121 is divided into a front section 170*a* and a rear 170*b*. The base 121 may be divided into any number of sections or compartments as desired. The base 121 includes a front wall 125, a rear wall 126, side walls 127 and 128, and a common bottom wall 129. Front wall 125, rear wall 126, side walls 127 and 128, and common bottom wall 129 together define interior compartment 130. Front wall 125, rear wall 126, side walls 127 and 128, and bottom wall 129 each have an interior surface and an exterior surface.

Base 121 has a front portion and a rear portion. The front portion of base 121 includes front wall 125 and portions of side walls 127 and 128 and bottom wall 129 adjacent front wall 125. The rear portion of base 121 includes rear wall 126 and portions of side walls 127 and 128 and bottom wall 129 adjacent rear wall 126.

Protruding from the rear portion of base 121 on the exterior surface of side walls 127 and 128 are pivot pins 132. Pivot pins 132 will engage with grooves 47 in cover 22 to secure base 121 to cover 22 as discussed above.

Front wall 125 includes a flexible bar 150 secured to its exterior surface. Preferably, flexible bar 150 is integrally molded with base 121 to form a single unit, thereby eliminating the need for a separate platform as disclosed in FIGS. 2, 4, 6 and 7. Flexible bar 150 includes a push tab 155 and an indentation 156 which forms a portion of the latching mechanism. Tab 46 on cover 22 engages with indentation 156 to secure base 121 to cover 22. To use the case after closing, the consumer simply pushes the push tab 155 inwardly toward the rear portion of the case 20. The inward movement of push tab 155 releases tab 46 from indentation 156 allowing the case 20 to be opened. The general operation of base 121 in combination with cover 22 is similar to that described above.

While particular embodiments of the present invention have been illustrated and described, it will be obvious to those skill in the art that various changes and modifications may be made without departing from the spirit and scope of the invention, and it is intended to cover in the appended claims all such modifications that are within the scope of this invention.

What is claimed is:

1. A case having front and rear portions comprising:

(a) a base having a front wall, a rear wall, a pair of side walls, and a common bottom wall which together define an interior compartment, each of said side walls having an interior surface and an exterior surface;

(b) a cover having a front wall, a pair of side walls, and a common top wall, each of said walls having an interior surface and an exterior surface;

(c) a pair of pivot pins protruding from the rear portion of said base on the exterior surfaces of said side walls;

(d) a pair of grooves extending substantially the entire length of the interior surfaces of said side walls of said cover, said grooves having a rib member at one end and a pivot pin receptacle at the opposing end, said pivot pins being positioned within said grooves such that said rib members releasably secure said base to said cover in a first position permitting said base and said cover to be moved axially and pivoted with respect to one another, and said pivot pins being positioned within said pivot pin receptacles permanently securing said base to said cover in a second position such that said base and said cover are pivotable with respect to one another about said pivot pins positioned within said pivot pin receptacles; and (e) means for latching said base and said cover together, said means being located in said front portion of said case.

2. A case according to claim 1, wherein said side walls of said cover include an assembly notch allowing said pivot pins of said base to be inserted into said grooves.

3. A case according to claim 1, wherein said grooves of said cover include a rib member located in said front portion of said cover for releasably securing said base and said cover in said first position.

4. A case according to claim 1, further comprising a pivot pin receptacle in said grooves for permanently securing said base to said cover in said second position.

5. A case according to claim 1, further comprising an inclined ramped portion located in said grooves adjacent said pivot pin receptacles.

6. A case according to claim 1, further comprising a platform secured to said base, said platform separating said base into multiple sections.

7. A case according to claim 6, wherein said means for latching said base and said cover together includes a push button located on the front portion of said platform.

8. A case according to claim 7, wherein said means for latching said case and said cover together includes a catch tab.

9. A case according to claim 8, wherein said push button includes an opening for receiving said catch tab.

10. A case having front and rear portions comprising:

(a) a base having a front wall, a rear wall, a pair of side walls, and a common bottom wall which together define an interior compartment, each of said walls having an interior surface and an exterior surface, said exterior surface of said front wall having a flexible bar attached thereto, said flexible bar including a push tab and an indentation;

(b) a cover having a front wall, a pair of side walls, and a common top wall, each of said walls having an interior surface and an exterior surface, said front portion of said cover having a catch tab cooperating with said indentation on said flexible bar for latching said cover to said base;

(c) a pair of pivot pins extending from the rear portion of the exterior surfaces of said base; and (d) a pair of grooves extending substantially the entire length of the interior surface of said side walls of said cover, said grooves having a rib member at one end and a pivot pin receptacle at the opposing end, said pivot pins being positioned within said grooves such that said rib members releasably secure said base to said cover in a first position permitting said base and said cover to be moved axially and pivoted with respect to one another, and said pivot pins being positioned within said pivot pin receptacles permanently securing said base to said cover in a second position such that said base and said cover are pivotable with respect to one another about said pivot pins positioned within said pivot pin receptacles.

11. A case according to claim 10, further comprising an inclined ramped portion located in said grooves adjacent said pivot pin receptacles.

* * * * *